US010626515B2

(12) United States Patent
Hasegawa

(10) Patent No.: US 10,626,515 B2
(45) Date of Patent: Apr. 21, 2020

(54) SURFACE ELECTROLYTIC TREATMENT APPARATUS FOR GARMENT ACCESSORY PART

(71) Applicant: YKK Corporation, Tokyo (JP)

(72) Inventor: Kenji Hasegawa, Kanagawa (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/588,841

(22) Filed: May 8, 2017

(65) Prior Publication Data

US 2017/0241033 A1 Aug. 24, 2017

Related U.S. Application Data

(62) Division of application No. 15/524,800, filed as application No. PCT/JP2014/080260 on Nov. 14, 2014.

(51) Int. Cl.

| | |
|---|---|
| ***C25D 17/02*** | (2006.01) |
| ***C25D 15/00*** | (2006.01) |
| ***C25D 15/02*** | (2006.01) |
| ***C25D 5/22*** | (2006.01) |
| ***C25D 21/10*** | (2006.01) |
| ***C25D 17/00*** | (2006.01) |
| *C25D 3/12* | (2006.01) |

(Continued)

(52) U.S. Cl.

CPC ..... *C25D 5/22* (2013.01); *C25D 17/00* (2013.01); *C25D 21/10* (2013.01); *C25D 3/12* (2013.01); *C25D 3/30* (2013.01); *C25D 3/38* (2013.01)

(58) Field of Classification Search

CPC ..... C25D 21/10; C25D 17/02; C25B 9/00; C25B 15/00; C25B 15/02

USPC ..... 204/273

See application file for complete search history.

(56) References Cited

U.S. PATENT DOCUMENTS

| | | | |
|---|---|---|---|
| 3,699,014 | A | 10/1972 | Eisner |
| 3,974,057 | A | 8/1976 | Henig |

(Continued)

FOREIGN PATENT DOCUMENTS

| | | | |
|---|---|---|---|
| CN | 101954618 | A | 1/2011 |
| JP | S48-73338 | A | 10/1973 |

(Continued)

OTHER PUBLICATIONS

International Preliminary Report on Patentability, PCT Application No. PCT/JP2014/080260, dated May 26, 2017.

(Continued)

*Primary Examiner* — Zulmariam Mendez

(74) *Attorney, Agent, or Firm* — Kilpatrick Townsend & Stockton LLP

(57) ABSTRACT

A method for subjecting garment accessories to a surface electrolytic treatment provides various metallic colors to metallic garment accessories in a cost effective manner. The method can provide a first metallic color on one side of outer surface of the garment accessory and provide a second metallic color on the other side of the outer surface, by placing one or more metallic garment accessories in an electrolytic solution in a non-contact state with an anode and a cathode for passing electric current through the electrolytic solution, passing electric current through the electrolytic solution and generating a bipolar phenomenon on the garment accessory.

6 Claims, 6 Drawing Sheets

(51) Int. Cl.
*C25D 3/30* (2006.01)
*C25D 3/38* (2006.01)

(56) References Cited

U.S. PATENT DOCUMENTS

| | | | | |
|---|---|---|---|---|
| 5,080,762 | A | 1/1992 | Ochiai et al. | |
| 5,469,605 | A | 11/1995 | Horikawa | |
| 2004/0234683 | A1 | 11/2004 | Tanaka et al. | |
| 2006/0231414 | A1* | 10/2006 | Butterfield | B23H 5/08 205/662 |
| 2014/0017512 | A1 | 1/2014 | Iimori et al. | |
| 2017/0321341 | A1 | 11/2017 | Hasegawa | |

FOREIGN PATENT DOCUMENTS

| | | | |
|---|---|---|---|
| JP | 54-104461 | A | 8/1979 |
| JP | S55-24940 | A | 2/1980 |
| JP | 57-110689 | A | 7/1982 |
| JP | S63-86885 | A | 4/1988 |
| JP | 01-139799 | A | 6/1989 |
| JP | 03-017300 | A | 1/1991 |
| JP | 068509/1994 | | 9/1994 |
| JP | 08-165596 | A | 6/1996 |
| JP | 10-102268 | A | 4/1998 |
| JP | 2000-243991 | A | 9/2000 |
| JP | 2002069689 | A | 3/2002 |
| JP | 2004-065849 | A | 3/2004 |
| JP | 2005-146304 | A | 6/2005 |
| JP | 2008-068229 | A | 3/2008 |
| JP | 2008-127618 | A | 6/2008 |
| JP | 2010202900 | A | 9/2010 |
| JP | 2011-516721 | A | 5/2011 |
| JP | 2013-128554 | A | 7/2013 |
| JP | 2013-155433 | A | 8/2013 |
| JP | 2014-019953 | A | 2/2014 |
| WO | 2009/108286 | A1 | 9/2009 |

OTHER PUBLICATIONS

International Search Report, PCT Application No. PCT/JP2014/080260, dated Mar. 3, 2015.
Office Action, Japanese Patent Application No. 2017-058054, dated Nov. 28, 2017.
Office Action, Japanese Patent Application No. 2016-558842, dated Mar. 20, 2018.
Extended European Search Report, European Patent Application No. 17000876.7, dated Jan. 2, 2018.
Office Action, Chinese Patent Application No. 201480083380.8, dated Jun. 5, 2018.
Extended European Search Report, European Patent Application No. 14906132.7, dated Jun. 27, 2018.
Chunhua, "Bipolar Phenomenon and its Applications", Electroplating & Pollution Control, vol. 10, No. 1, pp. 3-6, Jan. 31, 1990.
U.S. Appl. No. 15/524,800, Non-Final Office Action, dated May 1, 2019, 7 pages.
U.S. Appl. No. 15/524,800, Notice of Allowance, dated Nov. 6, 2019, 8 pages.

* cited by examiner

SURFACE ELECTROLYTIC TREATMENT APPARATUS FOR GARMENT ACCESSORY PART

This application is a divisional patent application of U.S. Application Ser. No. 15/524,800, which is a national stage application of PCT/JP2014/080260, both of which are incorporated herein by reference.

TECHNICAL FIELD

The present invention relates to a method for a surface electrolytic treatment of garment accessories, a garment accessory, and a method for producing garment accessories, and more particularly to a surface electrolytic treatment method for imparting metallic colors onto garment accessories such as metal parts for slide fasteners, metallic buttons and the like, utilizing a bipolar phenomenon, and to a garment accessory having such metallic colors and a method for producing such garment accessories.

BACKGROUND ART

Metallic garment accessories, such as elements for slide fasteners, snap buttons, and shell caps which are components of buttons are attached to clothes, bags and the like and form a part of their appearances. Therefore, high designability is required for the garment accessories, and the color tones presented by the garment accessories are one important factor for the designability. However, since the metallic colors of the base materials are limited, the metallic garment accessories are generally colored by painting, printing, plating and the like. However, the coloring by painting or printing may generally lose the metallic luster of the garment accessories. Special painting methods such as silver mirror coating finishing are also known in the art, but these methods are very expensive. Therefore, the plating (electroplating, electroless plating, substitution plating, chemical conversion treatment, etc.) is generally adopted in order to impart a metallic color different from that of the base material to the metallic garment accessary, and the metallic fastener elements, the snap buttons, the shell caps and the like are conventionally plated on their full surfaces by electroplating or chemical plating. For example, when the metallic fastener elements are plated, conductive fibers are woven in advance in fastener tapes to which the elements are attached, along the tape longitudinal direction, and a large number of elements are fixed to the fastener tapes by means of caulking such that the elements are brought into contact with the conductive fibers. Electricity is then applied to the conductive fibers while continuously passing the fastener tapes through a plating bath to cause cathodic polarization of the elements, thereby depositing the metal on the outer surfaces of the elements. However, this method takes labor for the reasons that adjustment is required such that the plating metal is not deposited on the conductive fibers, and the like, because the electric current is directly applied to the elements.

Recently, there have been demands for diversified and improved designability and fashionability in relation to the garment accessories. For example, there are needs for reversible fashions having glossy colors different between the front and back sides and for garment accessories having various glossy colors. However, in the plating method of the fastener tapes with the conductive fibers interwoven as stated above, it is difficult to perform one side plating. Further, if different colors are produced between the front and back surface or one side plating is carried out by the conventional plating method, for example, it is necessary to perform the plating while masking one of the front and back surfaces with a resin coating, then remove the mask, and optionally repeat the same process for the other of the front and back surfaces. However, such processes are unsuitable for the industrial production, because they take much labor and costs. In addition, since the shell cap is a part to be attached to the button body and the stopper body, it is originally sufficient to plate only the outside surface. However, the shell cap is subjected to full surface plating because the one side plating is expensive as described above.

As will be described below, the present inventor found a novel method for subjecting metallic garment accessories to a surface electrolytic treatment using a bipolar phenomenon. Prior arts which disclose the plating method utilizing the bipolar phenomenon include Japanese Patent Application Public Disclosure (KOKAI) No. 2002-69689 A1 (Patent Document 1), Japanese Patent Application Public Disclosure (KOKAI) No. 2010-202900 A1 (Patent Document 2), and Japanese Patent Application Public Disclosure (KOKAI) No. 2013-155433 A1 (Patent Document 3). Patent Document 1 discloses a method for applying electroplating (bipolar plating) to fine powder having a particle size of 50 μm or less, using the bipolar phenomenon. Patent Document 2 discloses a method for producing an electrical contact comprising forming a noble metal plated film on a surface of a bipolar plated film by an electroless plating method. Patent Document 3 discloses a method for electroplating electronic/electric parts by indirectly supplying electricity, using the bipolar phenomenon. Therefore, all of these documents are irrelevant to the garment accessories which are attached to clothes and bags and which thus require improved fashionability and designability. Further, conventionally, in the industry of garment accessories, the bipolar phenomenon has been considered to be a cause of plating failure such as discoloration or nonuniformity of the plated film on the object to be plated.

PRIOR ART DOCUMENT

[Patent Document 1] Japanese Patent Application Public Disclosure (KOKAI) No. 2002-69689 A1

[Patent Document 2] Japanese Patent Application Public Disclosure (KOKAI) No. 2010-202900 A1

[Patent Document 3] Japanese Patent Application Public Disclosure (KOKAI) No. 2013-155433 A1

SUMMARY OF INVENTION

Problem to be Solved by the Invention

One object of the present invention is to provide a method for subjecting garment accessories to a surface electrolytic treatment and a method for producing garment accessories, which can advantageously provide various metallic colors to metallic garment accessories in a cost effective manner.

Another object of the present invention is to provide a method for subjecting garment accessories to a surface electrolytic treatment and a method for producing garment accessories, which can concurrently impart different metallic colors to the front surface and back surface of the metallic garment accessory.

A further object of the present invention is to provide garment accessories having metallic colors that are different between the front surface and the back surface.

Means for Solving the Problem

According to one aspect of the present invention, there is provided a method for subjecting garment accessories to a surface electrolytic treatment, comprising placing one or more metallic garment accessories in an electrolytic solution in a non-contact state with an anode and a cathode for passing electric current through the electrolytic solution, passing electric current through the electrolytic solution and generating a bipolar phenomenon on the garment accessory to provide at least a part of the outer surface of the garment accessory with a metallic color(s) different from the color of the outer surface.

In the present invention, the metallic garment accessories include elements (teeth) for slide fasteners, lower stops, upper stops, sliders, pull tabs; buttons such as snap buttons, sew on buttons, and decorative buttons; mounting members for these buttons; parts for buttons such as shell caps; eyelets (including washers for the eyelets and the like); hook eyes (including parts for hanging the hook eyes); and similar metallic parts to be attached to clothing and bags, and the like. The garment accessories in the present invention may be made of, for example, copper, copper alloys, zinc, zinc alloys, aluminum, aluminum alloys, stainless steel and the like, but not limited thereto.

The surface electrolytic treatment according to the present invention may be applied directly to the garment accessory itself, i.e., to the outer surface of the base material, and may be applied to the outer surface of the garment accessory to which the under plating has been applied in advance, i.e., to the outer surface of the substrate. Therefore, the term "color of the outer surface" as used in the present invention refers to the color of the base material in the case where the base material is directly treated, and refers to the color of the under plating (the outer surface of the substrate) in the case where the base material has been already subjected to the under plating.

The present inventors have found that a variety of hues which were difficult to be achieved by the conventional plating methods could be imparted to the metallic garment accessories by separating the metallic garment accessories from the electrodes in the electrolytic solution and generating the bipolar phenomenon. In the present invention, the bipolar phenomenon is generated for the garment accessory(s) (hereinafter, also referred to as "treated article(s)") by placing the one or more metallic garment accessories in an electrolytic solution in the state where the accessories are separated from the anode and the cathode, and applying a voltage to the electrodes to apply electric current to the electrolytic solution. The electrolytic solution has higher resistance as compared with the treated article and generates a potential gradient, whereas the treated article has lower resistance and can be considered to be almost equipotential as a whole. Therefore, the bipolar phenomenon is generated, in which the anode-facing side of the treated article is negatively charged and the cathode-facing side is positively charged. Due to the bipolar phenomenon, dissolution (oxidation corrosion) or electrolysis of the metal takes place at the plus pole of the treated article (the side facing the cathode) to generate cations, and metal ions dissolved at the minus pole (the side facing the anode) or in the electrolytic solution are reduced and deposited. Hereinafter, in the specification, electrodeposition occurring on the anode-facing side of the treated article (negative pole) is also referred to as "bipolar plating". In such a way, a metallic color (first metallic color) different from the color of the base material or the substrate (under plating) can be imparted to the anode-facing side of the outer surface of the garment accessory by the bipolar plating. Further, a second metallic color different from any of the colors of the base material or the substrate and the first metallic color can be imparted to the cathode-facing side of the outer surface of the garment accessory by metal dissolution. In addition, various hues can be imparted to the garment accessory by a constant position or distance of the garment accessory in the bipolar plating relative to the electrodes, or regularly or irregularly changing the posture or distance. Furthermore, the hue imparted to the garment accessory can be changed such as by changing the type of electrolytic solution, metal ions added to the electrolytic solution, applied voltage, a time for energization, the posture and distance of the garment accessory relative to the electrodes, and the like. In the present invention, the term "non-contact state" in "placing one or more metallic garment accessories in the electrolytic solution in a non-contact state with the anode and the cathode" means that the treated article may be basically separated from the electrodes during the surface electrolytic treatment, and the treated article may temporarily come in contact with the electrodes. Thus, the "non-contact state" encompasses a case where the treated article temporarily comes in contact with the electrodes during passing electric current.

In the present invention, when the garment accessory is a brass material for example, the bipolar plating is usually applied directly to the base material. However, for example, when applying silver plating to fastener elements made of brass by the bipolar plating, copper plating or nickel plating can be performed by the ordinary electroplating before attaching the elements to the fastener tapes, and the elements can be then embedded in the tapes, and silver plating can be applied to one side of the elements by the bipolar plating. Further, when gold plating is applied to at least a part of the outer surface of the garment accessory by the bipolar plating, copper-tin plating or nickel plating is first applied to the base and gold plating by bipolar plating is then applied to this base plated surface. Furthermore, when the base material is a zinc alloy, cuprous cyanide plating as an under plating should be applied with a sufficient thickness.

The electrolytic solutions that can be used for the present invention include both those which do not contain any metal ion in the initial state and those which contain metal ions to be electrodeposited on the garment accessories. In the former, the metal dissolved from one side of the outer surface of the garment accessory basically deposits on the other side. Examples of the electrolytic solutions which do not contain any metal ion in the initial state include, but not limited to, for example acidic solutions obtained by diluting acetic acid, citric acid, hydrochloric acid, sulfuric acid, phosphoric acid, pyrophosphoric acid, sulfamic acid, formic acid or the like with water, and the like. Examples of the electrolytic solutions which contain metal ions include, but not limited to, general electroplating solutions, such as gold solutions, silver solutions, copper pyrophosphate solutions, copper sulfate solutions, nickel sulfamate solutions, nickel sulfate solutions, sodium hydroxide solutions, ammonium chloride solutions, potassium chloride solutions, potassium pyrophosphate solutions, and sodium pyrophosphate solutions.

According to the present invention, a metallic color different from the color of the outer surface of the garment accessory can be imparted to at least a part of the outer surface of the garment accessory by the bipolar plating. If the posture of the garment accessory relative to the electrodes is substantially constant, a first metallic color is produced on the anode-facing side of the outer surface of the garment accessory, and a second metallic color is produced on the cathode-facing side. However, the color produced on the outer surface of the garment accessory is variously changed by altering the orientation or distance of the garment accessory relative to the electrodes during the bipolar plating, or by applying an alternating current, or the like. For example, it is possible to shade off at least a part of the first and/or second metallic colors, or to generate a third metallic color as described below between the first metallic color and the second metallic color. Furthermore, it is also possible to render the whole garment accessories almost one color by randomly changing the posture of the garment accessory relative to the electrodes during the bipolar plating. In this case, there is a possibility that full surface plating can be applied to the garment accessories in a more cost effective manner than the conventional full surface plating. Further, even if the posture of the garment accessory relative to the electrodes is not constant but always changed during passing electric current through the electrolytic solution, the first metallic color is produced on a certain surface when the surface averagely faces the anode. In the present invention, the term "metallic color" does not refer to a specific and uniform metallic color, and may be variously changed depending on bipolar plating conditions even if the garment accessories formed from the same materials are used. The term "metallic color" includes, in addition to glossy metallic colors, smoldered metallic colors, brackish metallic colors, dull metallic colors and the like. For example, the second metallic color produced by metal dissolution may be matt and smoldered, and the surface having mixed metal redox films may become blackish.

In one embodiment of the present invention, the metallic color comprises a first metallic color and a second metallic color, and the first metallic color is provided on one side of the outer surface of the garment accessory while at the same time providing the second metallic color on the other side of the outer surface. Thus, the first metallic color by the bipolar plating is generated on the anode-facing side of the outer surface of the garment accessory while at the same time generating the second metallic color on the cathode-facing side of the outer surface. In this case, different hues can be simultaneously imparted to the front and back surfaces of the metallic buttons and the like, and for example, a separate metallic color can be simultaneously provided between the front and back surfaces of many metallic fastener elements attached to the edge portions of the slide fastener tapes. This can allow easy and cost effective mass-production of the buttons and fastener elements for reversible specification. The tones of the first and second metallic colors can be desirably changed, for example, by altering the materials or surface preparation for the garment accessories, the type and amount of the electrolytic solution, the voltage and energizing time, the posture and distance of the garment accessory relative to the electrodes, and the like. The stirring, flowing and the like of the electrolytic solution can facilitate the supplying of the metal ions to be deposited as the first metallic color.

In one embodiment of the present invention, the metallic color comprises a third metallic color, and the third metallic color is provided between the first metallic color and the second metallic color on the outer surface of the garment accessory. It is believed that the third metallic color is formed by competition between deposition and dissolution of the metal between the region where the first metallic color is produced by deposition of the metal and the region where the second metallic color is produced by dissolution of the metal. The constant posture of the treated article relative to the anode and the cathode during the bipolar plating would tend to narrow the range of the third metallic color, and the disturbed posture of the treated article relative to the electrodes would tend to widen the range of the third color. Depending on the bipolar plating conditions, the third metallic color may be rarely produced or invisible to the naked eye, and in some cases may appear clearly. The third metallic color usually has a gradation that gradually changes from the first metallic color to the second metallic color, but the gradation may be difficult to be seen with the naked eye unless it is carefully observed. Further, the boundary between the third metallic color and the first and/or second metallic color is not necessarily clear and may be blurred. For example, when providing the first metallic color to the front surface of the shell cap and providing the second metallic color to the back surface of the same shell cap, the third metallic color tends to occur on the outer side of the annular side portion of the shell cap. In this example, the third metallic color can also be produced on the outer peripheral portion of the surface of the shell cap, in addition to the outer side of the annular side portion of the shell cap. In this case, the surface of the shell cap changes from the first metallic color at the center to the third metallic color at the outer peripheral portion in a blurred fashion. The gradation of the third metallic color itself and the blurred boundary between the third metallic color and the first and/or second metallic colors will contribute to the diversity of the design.

The present invention may comprises the step of controlling the posture of the garment accessory such that the one side of the outer surface of the garment accessory faces the anode and the other side faces the cathode during passing electric current through the electrolytic solution. The mode of controlling the posture of the garment accessory includes a) a mode in which both the electrodes and the garment accessory are fixed in a stationary state, and b) a mode in which the posture is controlled such that one side and the other side of the outer surface of the garment accessory continuously face the anode and the cathode, respectively, while moving at least one of the electrode and the garment accessory. In case of the above a) mode, the relatively clear first and second metallic colors can be produced on one side and the other side of the garment accessory. In the above b) mode, the hues of the first and second metallic colors can be changed depending on the proportion or the time at which one side and the other side of the outer surface of the garment accessory face the anode and the cathode, respectively. Further, it is also desirable to control the distance of the garment accessory relative to the electrodes, in addition to control the posture of the garment accessory relative to the electrodes.

The present invention may comprise the step of polishing at least a part of the outer surface of the garment accessory during passing electric current through the electrolytic solution. In such a way, the garment accessory can be polished while coloring the garment accessory using the bipolar phenomenon. According to one embodiment of the present invention, the posture of the garment accessory can be adjusted by using polishing materials for polishing the garment accessory, for example, stainless pin media or stainless steel balls, which will be described below on the basis of the figures.

According to another aspect of the present invention, there is provided a metallic garment accessory comprising an outer surface having one side and the other side, the one side of the outer surface having a first metallic color and the other side of the outer surface having a second metallic color, the second metallic color being different from the first metallic color, wherein the first and second metallic colors are provided by a bipolar phenomenon, the bipolar phenomenon being generated on the garment accessary by passing electric current through an electrolytic solution in which the garment accessory is placed. Such a garment accessory can be produced using the surface electrolytic treatment method as described above or a method for producing garment accessories as described below.

In one embodiment of the present invention, a third metallic color is provided between the first metallic color and the second metallic color on the outer surface of the garment accessory. Further, in one embodiment of the present invention, the garment accessory is a set of elements for a slide fastener, a lower stop, an upper stop, a slider, a pull tab; a button; a mounting member for a button; a part for a button; an eyelet; and a hook eye.

According to still another aspect of the present invention, there is provided a method for producing a garment accessory(s) having a metallic color on at least a part of its outer surface, the metallic color being different from the color of the outer surface of the garment accessory(s), the method comprising the steps of placing one or more garment accessories in an electrolytic solution in a non-contact state with an anode and a cathode for passing electric current through the electrolytic solution, and passing electric current through the electrolytic solution to generate a bipolar phenomenon on the garment accessories. Such a producing method is to produce garment accessories using the surface electrolytic treatment method as described above.

In one embodiment of the present invention, the metallic color comprises a first metallic color and a second metallic color, the first metallic color being provided on one side of the outer surface of the garment accessory while at the same time providing the second metallic color on the other side of the outer surface. Further, in one embodiment of the present invention, the metallic color comprises a third metallic color, the third metallic color being provided between the first metallic color and the second metallic color on the outer surface of the garment accessory. Furthermore, in one embodiment of the present invention, the method further comprises the step of controlling the posture of the garment accessory such that the one side of the outer surface of the garment accessory faces the anode and the other side faces the cathode during passing electric current through the electrolytic solution. Further, in one embodiment of the present invention, the method further comprises the step of polishing at least a part of the outer surface of the garment accessory. Still further, in one embodiment of the present invention, the one or more garment accessories are selected from the group consisting of elements for slide fasteners, lower stops, upper stops, sliders, pull tabs; buttons; mounting members for buttons; parts for buttons; eyelets and hook eyes.

Effects of the Invention

According to the surface electrolytic treatment method and the method for producing the garment accessories of the present invention, various metallic colors can be advantageously provided to the metallic garment accessories using the bipolar phenomenon in a cost effective manner, and different metallic colors can be also concurrently imparted to the front and back surfaces of the metallic garment accessory.

According to the garment accessory of the present invention, the garment accessory can represent metallic colors different between the front surface and the back surface, thereby meeting the demand for the reversible specification, so that the designability and fashionability of the garment accessories can be improved.

MODES FOR CARRYING OUT THE INVENTION

Although some embodiments of the present invention will be described below with reference to the figures, the present invention is not limited to those embodiments, and appropriate modifications and the like may be made within the scope of the claims and their equivalents.

Elements for Slide Fasteners

Figure 1:
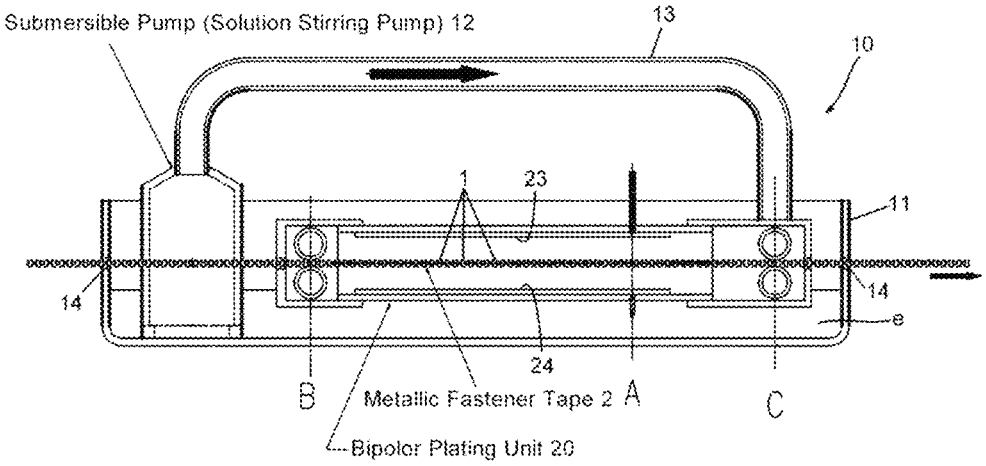
FIG. 1 is an explanatory side sectional view schematically showing a surface electrolytic treatment apparatus for subjecting elements for slide fasteners, an example of garment accessories, to a surface electrolytic treatment according to the present invention.
Figure 2:
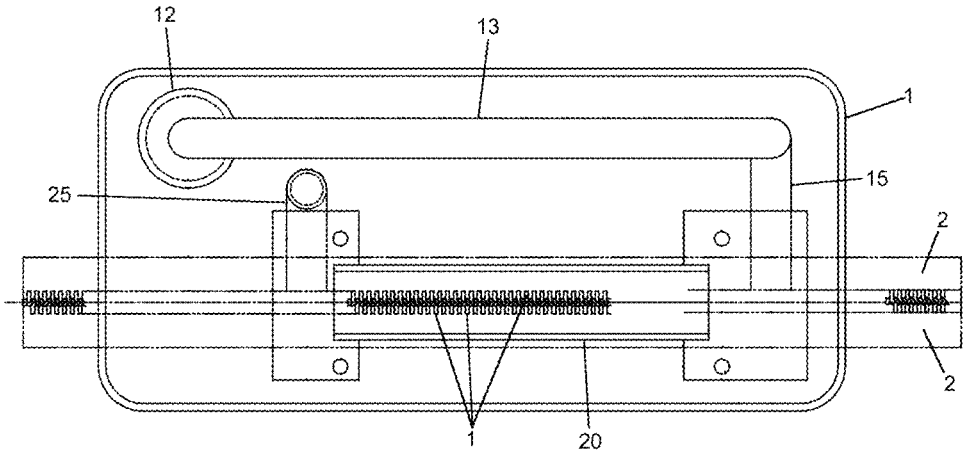
FIG. 2 is an explanatory plan view of FIG. 1.
Figure 3:
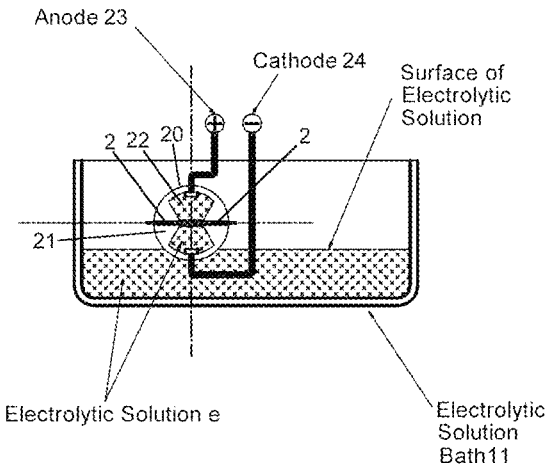
FIG. 3 is an explanatory cross-sectional view taken along line A in FIG. 1.
Figure 4:
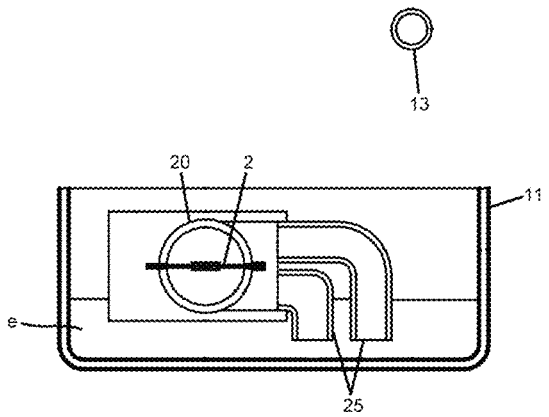
FIG. 4 is an explanatory cross-sectional view taken along line B in FIG. 1.
Figure 5:
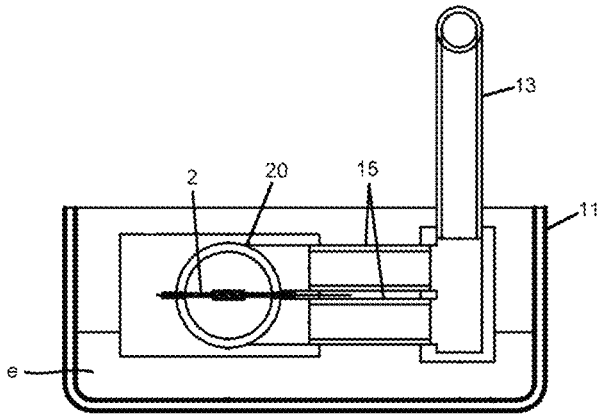
FIG. 5 is an explanatory cross-sectional view taken along line C of FIG. 1.
Figure 6:
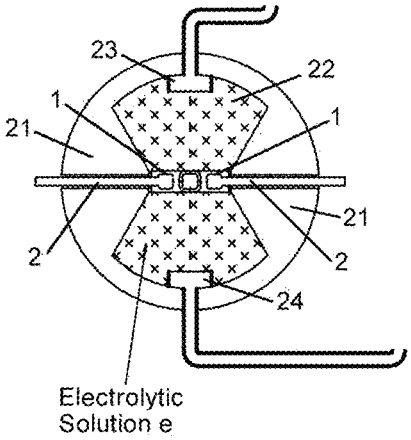
FIG. 6 is a partially enlarged view of FIG. 3.
Figure 7:
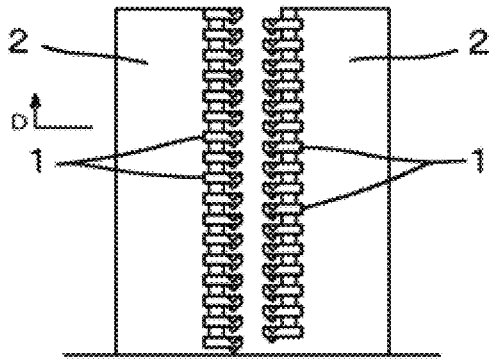
FIG. 7 is a partial plan view of a pair of right and left fastener tapes to which a number of elements have already been attached, respectively.

FIG. 1 is an explanatory side sectional view schematically showing a surface electrolytic treatment apparatus 10 for subjecting elements (teeth) 1 for slide fasteners, an example of garment accessories, to the surface electrolytic treatment according to the present invention. FIG. 2 is an explanatory plan view of FIG. 1. FIGS. 3 to 5 are explanatory sectional views taken along the line A, the line B and the line C in FIG. 1, respectively. FIG. 6 is a partially enlarged view of FIG. 3. FIG. 7 is a plan view showing a part of a pair of right and left fastener tapes 2, 2 to which a large number of elements 1 have already been attached, where a large number of elements 1 are continuously attached to the edges on the opposite sides in the width direction of the respective fastener tapes 2, 2 along the longitudinal direction. The surface electrolytic treatment apparatus 10 can subject the elements 1 to the surface electrolytic treatment while passing the elongated fastener tapes 2 with the elements 1 attached thereto and before being cut at predetermined lengths in the longitudinal direction.

The surface electrolytic treatment apparatus 10 comprises an electrolytic solution bath 11 which is opened upward and in which an electrolytic solution e is reserved; a cylindrical bipolar plating unit 20 which is disposed in the solution bath 11 and in which the pair of right and left fastener tapes 2 is intermittently or continuously passed from the left side to the right side of FIG. 1 in the state where the respective elements have been engaged or have been disengaged with each other; and a solution stirring pump 12 and a circulation path 13 for circulating the electrolytic solution e in the unit 20. The unit 20 is arranged in the solution bath 11 so that the axial direction is horizontal. The bipolar plating unit 20 includes a pair of left and right tape supporting portions 21 as viewed in FIG. 6, for passing through the fastener tapes 2 while supporting the same; an electrolytic solution flow channel 22 filled with the electrolytic solution e; and an anode 23 and a cathode 24 which are a pair of electrodes for energizing the electrolytic solution flow channel 22. The anode 23 and the cathode 24 are connected to an external power source (not shown). Each tape supporting portion 21 supports the tape 2 such that the element 1 of each tape 2 is exposed at its central portion in the up and down direction in the electrolytic solution flow channel 22. The edge portion on the side opposite to the element 1 in the width direction of each tape 2 is exposed to the outside of the unit 20 (see FIG. 6). The anode 23 is arranged at the top of the electrolytic solution flow channel 22 above the element 1 in the electrolytic solution flow channel 22 so as to extend along the axial direction (longitudinal direction) of the unit 20. The cathode 24 extends in the axial direction of the unit 20 at the bottom of the electrolytic solution flow channel 22 below the element 1 in the electrolytic solution flow channel 22 in the same manner as the anode 23. The left and right side walls (as viewed in FIG. 1) of the electrolytic solution bath 11 are also provided with openings 14 for passing through the fastener tapes 2. For example, the fastener tapes 2 are fed out from a roller (not shown) on the upstream side (left side in FIG. 1) and wound around a roller (not shown) on the downstream side (right side in FIG. 1), so that the fastener tapes 2 are passed inside the unit 20.

One end of the circulation path 13 is connected to the pump 12 and the other end of the circulation path 13 is connected to a right end (as viewed in FIG. 1) of the electrolytic solution flow channel 22 in the unit 20 via horizontal connecting pipes 15 (see FIG. 5). To the left end (as viewed in FIG. 1) of the electrolytic solution flow channel 22 in the unit 20, two discharge pipes 25 which are vertically provided and are downwardly bent (FIG. 4) are connected. In such a way, the electrolytic solution in the electrolytic solution bath 11 is supplied from the one end portion (the right end portion in FIG. 1) of the unit 20 through the circulation path 13 and the horizontal connecting pipes 15 to the inside of the electrolytic solution flow channel 22 by means of the pump 12, and is discharged from the other end portion (the left end portion in FIG. 1) of the electrolytic solution flow channel 22 through the discharge pipes 25 to the solution bath 11 outside the unit 22. The electrolytic solution e is thus circulated so as to flow inside the unit 20 in the direction opposite to the direction in which the fastener tapes 2 are passed through.

Figure 8:
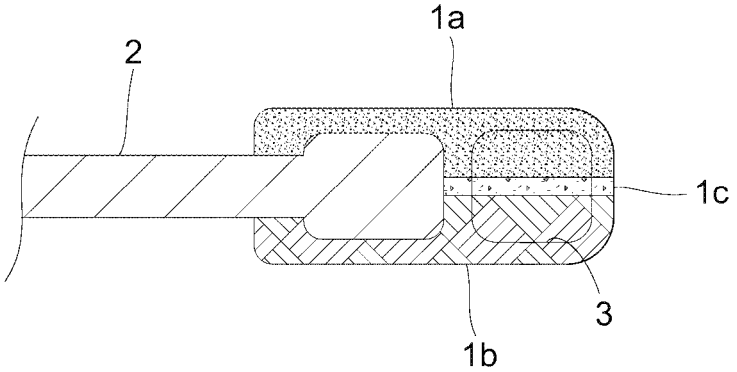
FIG. 8 is an enlarged side view schematically showing one element after a surface electrolytic treatment as viewed from the arrow D in FIG. 7, the tape being represented in cross section.

Next, the step of subjecting the fastener elements 1 to the surface electrolytic treatment using the surface electrolytic treatment apparatus 10 as described above will be described. First, the tapes 2 are moved so that a group of the elements 1 to be treated is arranged between the anode 23 and the cathode 24 in the electrolytic solution flow channel 22 in the unit 20, and the movement of the tapes 2 is then stopped. In this embodiment, the elements 1 between the pair of tapes 2 are disengaged to perform the surface treatment, but the engaged elements 1 may be targeted. Further, in this embodiment, the movement of the tape 2 is stopped during the surface treatment by way of example, but the surface treatment can be performed while continuously moving the tapes 2. For the surface treatment in the apparatus 10, in both the mode where the surface treatment is performed by stopping the tapes 2 and the mode where the surface treatment is performed while moving the tapes 2, the orientation and distance of the element 1 relative to the electrodes 23, 24 are constant. Electric current is then passed through the electrolytic solution flow channel 22 by applying a voltage between the anode 23 and the cathode 24 while circulating the electrolytic solution e by driving the pump 12. The circulation of the electrolytic solution e facilitates the supply of the metal ions to be deposited. After a certain period of time, the energization and the actuation of the pump 12 are stopped. During the energization, the bipolar phenomenon is produced on the elements 1 in the electrolytic solution e, and on one hand, the cathode 24-facing side of the bottom outer surface of the element 1 is positively charged to result in the metal dissolution, and on the other hand, the anode 23-facing side of the top outer surface of the element 1 is negatively charged so that the metal ions dissolved in the positive side are reduced and deposited. In addition, circulating the electrolytic solution e can increase the rate at which the metal ions of the elements 1, which have been dissolved in the positive pole, are deposited in the negative pole. FIG. 8 is an enlarged side view schematically showing one of the elements 1 after the surface electrolytic treatment as viewed from the arrow D in FIG. 7, the tapes 2 being represented in cross-section. As shown in this figure, the top (front surface) side of the outer surface of the element 1, which faced the anode 23, produces a first metallic color 1*a* by the bipolar plating, and the bottom (back surface) side which faced the cathode 24 produces a second metallic color 1*b* by the metal dissolution. Furthermore, depending on electrolytic treatment conditions, a third metallic color 1*c* that gradually changes from the first metallic color 1*a* to the second metallic color 1*b* may be produced between the first metallic color 1*a* and the second metallic colors 1*b* on the outer surface of the element 1. In FIG. 8, the boundary between the third metallic color 1*c* and the first and second metallic colors 1*a*, 1*b* is depicted by a straight line for the convenience. Further, the reference number 3 in FIG. 8 is a concave portion 3 on one side of an engaging head of the element 1, into which a convex portion of an engaging head of another element 1 is inserted, the concave portion 3 being adjacent the concave portion 3 in the engaged state of the elements 1. In addition, since a very small amount of the metal of the element 1 is dissolved in the positive pole and a very small amount of the metal is deposited in the negative pole, any function of the element 1 is not impaired. These first to third metallic colors 1*a*, 1*b* and 1*c* are different from the color of the base material or the substrate of the element 1. Thus, metallic colors different between the front and back surfaces can be concurrently imparted to the fastener element 1, so that the fastener elements 1 for the reversible design can be easily and cost-effectively produced.

Shell Cap

Figure 9:
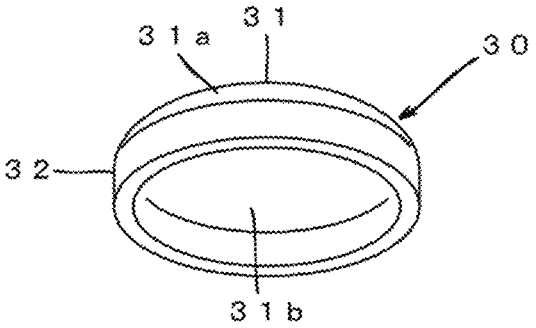
FIG. 9 is a perspective view of a shell cap.
Figure 10:
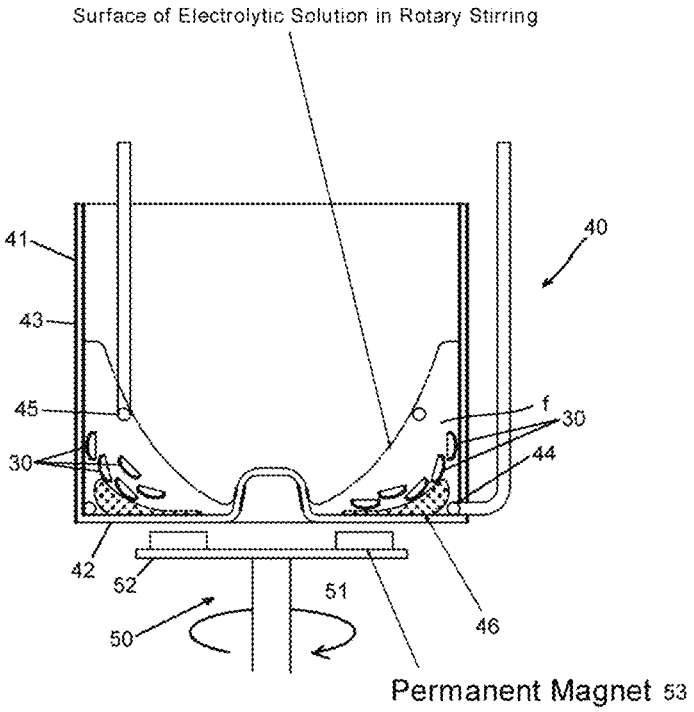
FIG. 10 is an explanatory view of a surface electrolytic treatment apparatus for performing a surface electrolytic treatment while polishing a large number of shell caps.

Next, examples in which a shell cap, a component of buttons or button mounting members, as an example of the garment accessories, is subjected to the surface electrolysis treatment will be described. FIG. 9 is a perspective view of a shell cap 30. The shell cap 30 comprises a disc portion 31 having a front surface 31*a* and a back surface 31*b*; and an annular side portion 32 projecting from the outer periphery of the disc portion 31 to the back surface side in the axial direction. FIG. 10 shows a surface electrolytic treatment apparatus 40 for applying the surface electrolytic treatment while polishing a large number of shell caps 30. The apparatus 40 is produced by arranging electrodes to a commercially available magnetic polishing rotary barrel apparatus, as described below. The apparatus 40 comprises a cylindrical container 41 that is open upward; and a rotating mechanism 50 provided below the container 41. The container 41 has a circular bottom plate 42 and a peripheral side plate 43, and the central portion of the bottom plate 42 is raised upward. At a corner between the bottom plate 42 and the peripheral side plate 43 in the container 41, an annular anode 44 is arranged so as to extend along the circumferential direction. Further, an annular cathode 45 is extended along the circumferential direction at the position upwardly away from the bottom plate 42 and radially inwardly away from the circumferential side plate 43 in the container 41. The position of the cathode 45 is set such that the cathode 45 is immersed in the electrolytic solution f in rotary stirring, as will be described below. The anode 44 and cathode 45 are connected to an external power source (not shown). The container 41 contains the electrolytic solution f, a large number of shell caps 30 to be treated, and ferromagnetic media 46 consisting of a large number of stainless steel pins and balls as polishing materials, which functions so that the shell caps 30 are maintained at a generally constant posture while polishing the shell caps 30. In addition, the shell cap 30 is made of a nonmagnetic metal.

The rotating mechanism 50 includes a rotating shaft 51 having one end connected to an output portion of a motor (not shown); a rotating plate 52 connected to the other end of the rotating shaft 51; and one of more permanent magnets 53 disposed onto the rotating plate 52. As the permanent magnets 53 on the rotating plate 52 are rotated by the rotation of the rotating shaft 51, the media 46 are rotated in the container 41. Accordingly, the electrolytic solution f in the container 41 is rotatively stirred, and in this case, the liquid level of the electrolytic solution f rises from the center to the peripheral side plate 43 of the radial outside by the centrifugal force. The position of the cathode 45 is set such that the cathode 45 is immersed in the electrolytic solution fin rotary stirring.

During fluidizing or flowing the media 46 and the electrolytic solution f in the container 41 by the permanent magnets 53 of the rotating mechanism 50, the media 46 is attracted downward in the container 41 by the permanent magnets 53, and the caps 30 also put on the media 46 due to the difference in specific gravity between the media 46 and the shell caps 30. In this state, the caps 30 are moving while being forced by media 46 and the electrolytic solution f. Therefore, the caps 30 during the motion are not in contact with the anode 44 basically. Further, the amount of the electrolytic solution f, the rotating speed of the rotating mechanism 50, the number of the caps 30 to be introduced, and the position of the cathode 45, and the like are set such that the cathode 45 is not basically in direct contact with the caps 30 during the motion and is immersed in the electrolytic solution f in stirring. In such a way, the caps 30 will maintain the state that is away from the anode 44 and the cathode 45 during the motion. It should be noted that the caps 30 may be temporarily contacted with the anode 44 or cathode 45 as long as the caps 30 are not in contact with the electrodes in most part of the energization period.

When subjecting the shell cap 30 to the surface electrolytic treatment, the rotating mechanism 50 is rotated to rotatively flow or fluidize media 46 and the electrolytic solution f in the container 41, while passing electric current through the electrolytic solution f by applying an voltage between the anode 44 and the cathode 45. This will generate the bipolar phenomenon on each shell cap 30 in the electrolytic solution f Each cap 30 does not have the constant posture and distance relative to the electrodes during the rotational fluidization of the media 46 and the electrolytic solution f, but each cap 30 tries to keep the position with lowest physical liquid resistance while undergoing the centrifugal force. Therefore, each cap 30 moves such that the front surface 31*a* of the disc portion 31 of each cap 30 averagely faces the downward anode 44 and the back surface 31*b* of the disc portion 31 averagely faces the upward cathode 45. So, when a certain period of time is passed, the posture and the distance of the caps 30 relative to the electrodes are substantially the same ratio in all the caps 30. After a certain period of time, the rotation of the rotating mechanism 50 and the energization are stopped. In such a way, the first metallic color is produced on the front surface 31*a* of the disk portion 31 of each cap 30 due to the metal deposition, and the second metallic color is produced on the back surface 31*b* and the inner surface of the annular side portion 32 due to the metal dissolution. Further, the third metallic color that gradually changes from the first metallic color to the second metallic color is produced on the outer surface of the annular side portion 32 of each shell cap 30. In the above treatment, each cap 30 is polished in contact with the medium 46 in the electrolytic solution f during the rotational stirring. Thus, the media 46 brings about the polishing while adjusting the posture of each cap 30. Furthermore, the media 46 stirs the electrolytic solution f, thereby facilitating the supply of metal ions to be deposited. If the treatment as stated above is carried out by changing the anode 44 to a cathode and the cathode 45 to an anode, the second metallic color will be produced on the front surface 31*a* of the disk portion 31 of the cap 30, and the first metallic color will be produced on the back surface 31*b*. In addition, the hues of the first, second and third metallic colors can be changed by altering the type and amount of the electrolytic solution f, the rotating speed of the rotating mechanism 50, the amount of the caps 30 and media 46 to be introduced, the voltage and electrical current between the electrodes, and the like. The range where the third metallic color is produced can be also changed, and for example, the third metallic color can be produced on not only the outer surface of the annular side portion 32 of the shell cap 30, but also on the outer peripheral portion of the front surface 31*a* of the disc portion 31.

EXAMPLES

Example 1

The elements 1 for slide fasteners, which were made of brass (a copper alloy) and which did not undergo any under plating was subjected to the following surface treatment using the surface electrolytic treatment apparatus 10 shown in FIG. 1 and the like. 2000 ml of an acidic solution (pH=3.2) obtained by mixing a grain vinegar with water at a ratio of 3:17 was used as an electrolytic solution e. The electrolytic solution e was fed to the unit 20 at rate of 11 l/min by means of the solution stirring pump 12. Two parallel copper wires each having a diameter of 2 mm and a length of 160 mm were used as the anode 23, and one stainless steel wire (SUS304) having a diameter of 3 mm and a length of 160 mm was used as the cathode 24. The flow rate of the electrolytic solution in the electrolytic solution flow channel 22 between the electrodes 23 and 24 was maintained at 0.5 m/s, and a voltage of 3 V were applied to the electrodes, and pre-energization was then carried out for about 30 minutes in order to increase the copper ion concentration. The current value during the energization was 0.1 A or less. The metal fastener tapes 2 to which the elements 1 for the slide fasteners were attached were mounted as shown in FIG. 1, and the energization was performed at 3 V for about 30 minutes. The current density for the elements 1 at this time could not be determined because the calculation was difficult due to the use of the indirect (non-contact) electrodes. The temperature of the solution in the electrolytic solution flow channel 22 was 19° C. at the start of the treatment, which was increased to 20° C. at the end of the treatment. During the energization, the fastener tapes 2 were in the stopped state, and the elements 1 were in the engaged state. In such a way, the anode 23-facing side (the 1*a* side in FIG. 8) of the outer surface of the element 1 was changed from the initial brass color to a copper color as the first metallic color, and the cathode 24-facing side (the 1*b* side in FIG. 8) was changed to a dull brass color as the second metallic color. The cross section of the metallic element used herein had a width of 6 mm and a height of 2.5 mm in the engaged state. Each of the front and back surfaces of the metallic element 1 used herein was analyzed by using an energy dispersive X-ray fluorescence spectrometer, and found that on the anode 23-facing side, a copper component was 67.086%, a zinc component was 28.964%, and the balance was 3. 950%. Further, on the cathode 24-facing side, a copper component was 63.561%, a zinc component was 32.065%, and the balance was 4.374%.

Example 2

The metallic slide fastener elements 1 (a copper alloy) which were embedded in the fastener tapes 2 and which did not undergo any under plating were subjected to the following surface treatment using the surface electrolytic treatment apparatus 10 shown in FIG. 1 and the like. The electrolytic solution e was formed by adding 1600 ml of purified water to 400 ml of an acidic tin plating solution (Part No. BP-SN-02) from YAMAMOTO-MS Co., Ltd. The electrolytic solution e was fed to the unit 20 at rate of 11 l/min by the solution stirring pump 12. The pH value at this time was 0.8. The flow rate of the electrolytic solution in the electrolytic solution flow channel 22 between the electrodes 23 and 24 was maintained at about 0.5 m/s, and using stainless steel wires (SUS304) each having a diameter of 3 mm and a length of 160 mm as both the anode 23 and the cathode 24, a voltage of 5 V were applied to the electrodes to perform the energization for about 30 minutes. The current value during the energization was initially 2.0 A, which was finally increased to 2.5 A. At this time, the temperature of the solution was 19° C. at the start of the treatment, and was 22° C. at the end of the treatment. During the energization, the fastener tapes 2 were in the stopped state, and the elements 1 were in the engaged state. In such a way, the anode 23-facing side (the 1*a* side in FIG. 8) of the outer surface of the element 1 was changed from the brass color to a dull silver color (tin color) as the first metallic color, and the cathode 24-facing side (the 1*b* side in FIG. 8) was changed to a dull brass color as the second metallic color. The cross section of the metallic element used herein had a width of 6 mm and a height of 2.5 mm. Each of the front and back surfaces of the metallic element 1 used herein was analyzed by using an energy dispersive X-ray fluorescence spectrometer, and found that on the anode 23-facing side, a copper component was 57.940%, a zinc component was 29.779%, a tin component was 7.954%, and the balance was 4.327%. Further, on the cathode 24-facing side (the 1*b* in FIG. 8), a copper component was 60.854%, a zinc component was 32.538%, and the balance was 6.608%, and no tin component was detected.

Example 3

The shell caps 30 made of brass (a copper alloy) were subjected to the following surface treatment using the surface electrolytic treatment apparatus 40 shown in FIG. 10. The shell caps each having a diameter of 11 mm and a height of 3 mm were used. Using 190 ml of an acidic solution (pH=3.2) obtained by mixing a grain vinegar with water at a ratio of 3:16 as the electrolytic solution f, a voltage of 9 V was applied to the electrodes and an electric current of about 100 mA was applied for about 20 minutes. A stainless steel wire (SUS304) having a diameter of 3 mm and a length of 100 mm was used as the cathode 45, and a copper wire having a diameter of 2 mm and a length of 250 mm was used as the anode 44. To the container 41 were introduced 10 g of stainless pin media each having a length of 5 mm and a diameter of 0.3 mm, and 15 g of stainless pin media each having a length of 5 mm and a diameter of 0.5 mm (total 25 g of the two media), as the media 46. Further, the rotating speed of the rotating mechanism 50 was set to 1000 rpm. The temperature of the electrolytic solution f was 14° C. at the start of the treatment, which was increased to 22° C. at the end of the treatment. In such a way, the front surface 31*a* of the disc portion 31 of the cap 30 was changed from the brass color to a copper color as the first metallic color, and the back surface 31*b* and the inner surface of the annular side portion 32 were changed to a blackish brass color as the second metallic color. The outer side surface of the annular side portion 32 was changed to a blackish metallic color that gradually changed from the first metallic color to the second metallic color, as the third metallic color. A component analysis for the base material of the shell cap 30 before the surface treatment showed that on the front surface 31*a* side, a copper component was 66.563%, a zinc component was 33.293%, and the balance was 0.144%, and that on the back surface 31*b* side, a copper component was 66.478%, a zinc component was 33.381%, and the balance was 0.141%, and that both the front and back surfaces had substantially the same component ratio. The same component analysis for the cap 30 after the surface treatment showed that on the front surface 31*a* side, a copper component was 67.607%, a zinc component was 32.281%, and the balance was 0.112%, and that on the back surface 31*b* side, a copper component was 66.486%, a zinc component was 33.411%, and the balance was 0.103%.

Example 4

The shell caps 30 made of brass (a copper alloy) were subjected to the following surface treatment using the surface electrolytic treatment apparatus 40 shown in FIG. 10. Ten shell caps each having a diameter of 11 mm and a height of 3 mm were used. Using 200 ml of an acidic solution (pH=2.9) obtained by adding 100 cc of purified water to 100 cc of an acidic nickel plating solution (Part No. BP-NI-01) from YAMAMOTO-MS Co., Ltd., as the electrolytic solution f, a voltage of 16 V was applied to the electrodes and an electric current of about 5.5 A was applied for about 10 minutes. A stainless steel wire (SUS304) having a diameter of 3 mm and a length of 100 mm was used as the cathode 45, and a copper wire having a diameter of 2 mm and a length of 250 mm was used as the anode 44. To the container 41 were added 10 g of stainless pin media each having a length of 5 mm and a diameter of 0.3 mm and 15 g of stainless pin media each having a length of 5 mm and a diameter of 0.5 mm (total 25 g of the two media), as the media 46. Further, the rotating speed of the rotating mechanism 50 was set to 1000 rpm. The temperature of the electrolytic solution f was 14° C. at the start of the treatment, which was increased to 31° C. at the end of the treatment. In such a way, the front surface 31*a* of the disc portion 31 of the cap 30 was changed from the brass color to a nickel color as the first metallic color, and the back surface 31*b* and the inner surface of the annular side portion 32 were changed to a whitish dull brass color as the second metallic color, and further the outer side surface of the annular side portion 32 was changed to a metallic color including a blackish copper color that gradually changed from the first metallic color to the second metallic color, as the third metallic color. The base material of the shell cap 30 used in this Example was the same as that of Example 3. A surface component analysis after the surface treatment showed that on the front surface 31*a* side, a copper component was 68.480%, a zinc component was 29.555%, a nickel component was 1.825% and the balance was 0.140%, and that on the back surface 31*b* side, a copper component was 66.420%, a zinc component was 33.397%, and the balance was 0.183%. The results demonstrated that on the front surface 31*a* side, the copper component was increased as well as the nickel component was detected, and on the back surface 31*b* side, no nickel component was detected and there was no significant change from the base material component.

Figure 11:
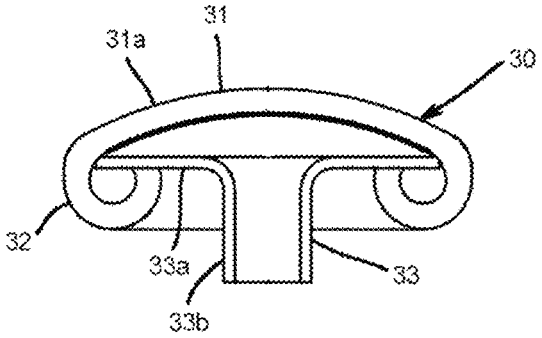
FIG. 11 is a schematic cross-sectional view showing a button mounting member to which a shell cap is assembled.
Figure 12:
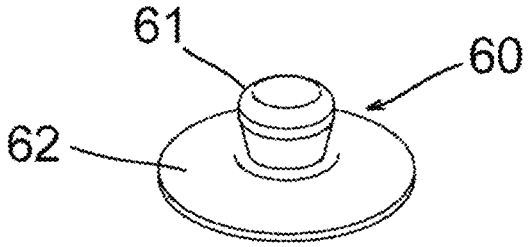
FIG. 12 is a perspective view showing a male snap button which is another example of metallic garment accessories.
Figure 13:
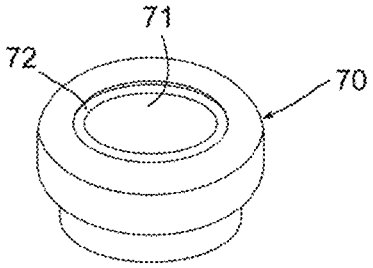
FIG. 13 is a perspective view showing a female snap button which is still another example of metallic garment accessories.

The shell cap 30 is used after being put over the button mounting member body 33, for example, as a part of the button mounting member shown in FIG. 11. More particularly, the button mounting member body 33 includes a circular base portion 33*a* and the shaft portion 33*b*, and the cap 30 covers the upper surface of the base portion 33*a* of the body 33, and is attached by curving the annular side portion 32 downward relative to the disc portion 33*a* of the body 33. Therefore, any plating is not originally required for the back surface 31*b* of the disc portion 31 and the inner surface of the annular side portion 32, but in the prior art plating method, the costs were increased for the reasons that the masking was necessary in order to apply one side plating, and the like. In this regard, the surface electrolytic treatment method according to the present invention can apply the bipolar plating only onto the front surface 31*a* of the disk portion 31 of the shell cap 30 (and the outer surface of the annular side portion 32), thereby cost-effectively perform the one side plating by reducing the amount of the plating metal. For the treatment with the surface electrolytic treatment apparatus 40, the shell cap 30 has been illustrated as the garment accessory, but only the button mounting member body 33, or the button mounting member with the cap 30 and the mounting member body 33 assembled as shown in FIG. 11 can be subjected to the surface electrolytic treatment with the surface electrolytic treatment apparatus 40. Circular buttons such as the metallic male snap button 60 (see FIG. 12), the female snap button (see FIG. 13), or decorative buttons such as rivet burrs and eyelets (not shown), which will have a shape such that the posture is constant when immersed in the solution, do not require any supporting member, and the sliders and the pull tabs for the slide fasteners and hook eyes and the like can be also treated in substantially the same manner by using the supporting member. The male snap button shown in FIG. 12 is provided with a projection 61 and a base 62. Female snap 70 shown in FIG. 13 includes a projection receiving portion 71 and a spring 72.

DESCRIPTION OF REFERENCE NUMERALS

1 element for a slide fastener
2 fastener tape
1*a* first metallic color
1*b* second metallic color
1*c* third metallic color
10, 40 surface electrolytic treatment apparatus
11 electrolytic solution bath
12 pump
13 circulation path
20 bipolar plating unit
22 electrolytic solution flow channel
23,44 anode
24,45 cathode
30 shell cap
41 container
46 ferromagnetic pin media
50 rotating mechanism
53 permanent magnet
e, f electrolytic solution

The invention claimed is:

1. A surface electrolytic treatment apparatus for subjecting metallic garment accessories to a surface electrolytic treatment, comprising:

a container, in which one or more metallic garment accessories are contained, the container having a bottom plate and a peripheral side plate extending from the bottom plate;

an electrolytic solution to be contained in the container;

a number of magnetic polishing materials to be contained in the container, for polishing the garment accessories;

a rotating mechanism including one or more magnets for rotating the polishing materials in the container in a circumferential direction from outside the container, the rotating mechanism being disposed outside the container; and an anode and an cathode for energizing the electrolytic solution which is rotatively flowing in the container by the rotating polishing materials, wherein the anode and the cathode are distinct from the garment accessories and the polishing materials, wherein the polishing materials rotating in the container and the electrolytic solution relatively flowing in the container are configured to force the garment accessories to move in the container, and wherein the anode is configured to deposit metal ions on the garment accessories.

2. The apparatus according to claim 1, wherein one of the anode and the cathode is arranged at a corner between the bottom plate and the peripheral side plate along the circumferential direction, and the other of the anode and the cathode is arranged at a position away from the bottom plate and the peripheral side plate along the circumferential direction.

3. The apparatus according to claim 1, wherein the anode and the cathode extend in the circumferential direction.

4. The apparatus according to claim 1, wherein the polishing materials are pins or balls.

5. The apparatus according to claim 1, wherein the garment accessories are a shell cap.

6. The apparatus according to claim 1, wherein the rotating mechanism includes a rotating shaft having one end connected to an output part of a motor, and a rotating plate which is connected to the other end of the rotating shaft and on which the magnets are disposed.

* * * * *